US006168501B1

(12) United States Patent
Kamijima

(10) Patent No.: US 6,168,501 B1
(45) Date of Patent: Jan. 2, 2001

(54) GRINDING METHOD OF MICROELECTRONIC DEVICE

(75) Inventor: Akifumi Kamijima, Tokyo (JP)

(73) Assignee: TDK Corporation, Tokyo (JP)

( * ) Notice: Under 35 U.S.C. 154(b), the term of this patent shall be extended for 0 days.

(21) Appl. No.: 09/361,615

(22) Filed: Jul. 27, 1999

(30) Foreign Application Priority Data

Jul. 29, 1998 (JP) ..... 10-227540

(51) Int. Cl.[7] ..... B24B 1/00
(52) U.S. Cl. ..... 451/28; 451/41; 134/7
(58) Field of Search ..... 451/28, 41; 134/7

(56) References Cited

U.S. PATENT DOCUMENTS 3,676,963 * 7/1972 Rice et al. ..... 451/39
4,256,535 * 3/1981 Banks ..... 438/691
5,422,316 * 6/1995 Desai et al. ..... 438/693
5,435,772 * 7/1995 Yu ..... 451/63
5,562,529 * 10/1996 Kishii et al. ..... 451/36
5,584,898 * 12/1996 Fulton ..... 51/309
5,695,384 * 12/1997 Beratan ..... 451/28
5,972,124 * 10/1999 Sethuraman et al. ..... 134/7

* cited by examiner

*Primary Examiner*—Stephen F. Gerrity
*Assistant Examiner*—Rhonda E. Sands
(74) *Attorney, Agent, or Firm*—Armstrong, Westerman, Hattori, McLeland & Naughton

(57) ABSTRACT

A method of grinding a microelectronic device includes a step of preparing an abrasive member by crushing a solid-phase liquid into massive form and by compacting the crushed solid-phase liquid, an abrasive member by compacting a solid-phase gas, or an abrasive member by crushing a solid-phase liquid into massive form, by mixing the crushed solid-phase liquid with a solid-phase gas and by compacting the mixed solid-phase liquid and solid-phase gas, and a step of pressing a surface of the microelectronic device to be ground against the abrasive member.

9 Claims, 1 Drawing Sheet

GRINDING METHOD OF MICROELECTRONIC DEVICE

FIELD OF THE INVENTION

The present invention relates to a grinding method of a microelectronic device such as a thin-film magnetic head wafer.

DESCRIPTION OF THE RELATED ART

When fabricating a microelectronic device such as a thin-film magnetic head, various thin-film layers may be deposited by sputtering and then each of the deposited layers is patterned by using a lift-off process, a milling process or both lift-off and milling processes. During this patterning process, unnecessary protrusions such as burrs may be formed on the patterned layer of the microelectronic device.

However, there has been no method for effectively removing such unnecessary protrusions of the patterned layer without adversely affecting the quality of the magnetic head wafer. Such unnecessary protrusions may be in fact removed by sandblasting. However, the impinged abrasive will cause scratches or flaws on the sandblasted surface, and therefore the sandblasting method cannot be adopted for removing the protrusions.

SUMMARY OF THE INVENTION

It is therefore an object of the present invention to provide a grinding method of a microelectronic device, whereby unnecessary protrusions such as burrs that may be produced on a patterned layer of the microelectronic device during patterning can be effectively removed.

According to the present invention, a method of grinding a microelectronic device includes a step of preparing an abrasive member by crushing a solid-phase liquid into massive form and by compacting the crushed solid-phase liquid, an abrasive member by compacting a solid-phase gas, or an abrasive member by crushing a solid-phase liquid into massive form, by mixing the crushed solid-phase liquid with a solid-phase gas and by compacting the mixed solid-phase liquid and solid-phase gas, and a step of pressing a surface of the microelectronic device to be ground against the abrasive member.

Grinding a microelectronic device by means of an abrasive member produced by crushing a solid-phase liquid into massive form and by compacting the crushed solid-phase liquid, an abrasive member produced by compacting a solid-phase gas, or an abrasive member produced by crushing a solid-phase liquid into massive form, by mixing the crushed solid-phase liquid with a solid-phase gas and by compacting the mixed solid-phase liquid and solid-phase gas will result that unnecessary protrusions such as burrs produced during patterning can be effectively removed without inviting scratches or flaws on the ground surface. Therefore, it is possible to enhance yields of the microelectronic device.

It is preferred that the method further includes a step of relatively moving the microelectronic device to be ground and the abrasive member. This relatively moving step may include a step of rotating the abrasive member and/or may include a step of rotating the microelectronic device itself about its axis.

It is preferred that the solid-phase liquid consists of ice.

It is also preferred that the solid-phase gas consists of dry ice. If dry ice is used as for the abrasive member, the ground surface of the microelectronic device can be kept dry resulting that better controls of products can be expected. In addition, since the ground surface of the microelectronic device is covered by a thin gaseous phase of vaporized gas from the dry ice, its patterned surface can be protected from occurrence of scratches or flaws.

Further objects and advantages of the present invention will be apparent from the following description of the preferred embodiments of the invention as illustrated in the accompanying drawings.

DESCRIPTION OF THE PREFERRED EMBODIMENT

Figure 1:
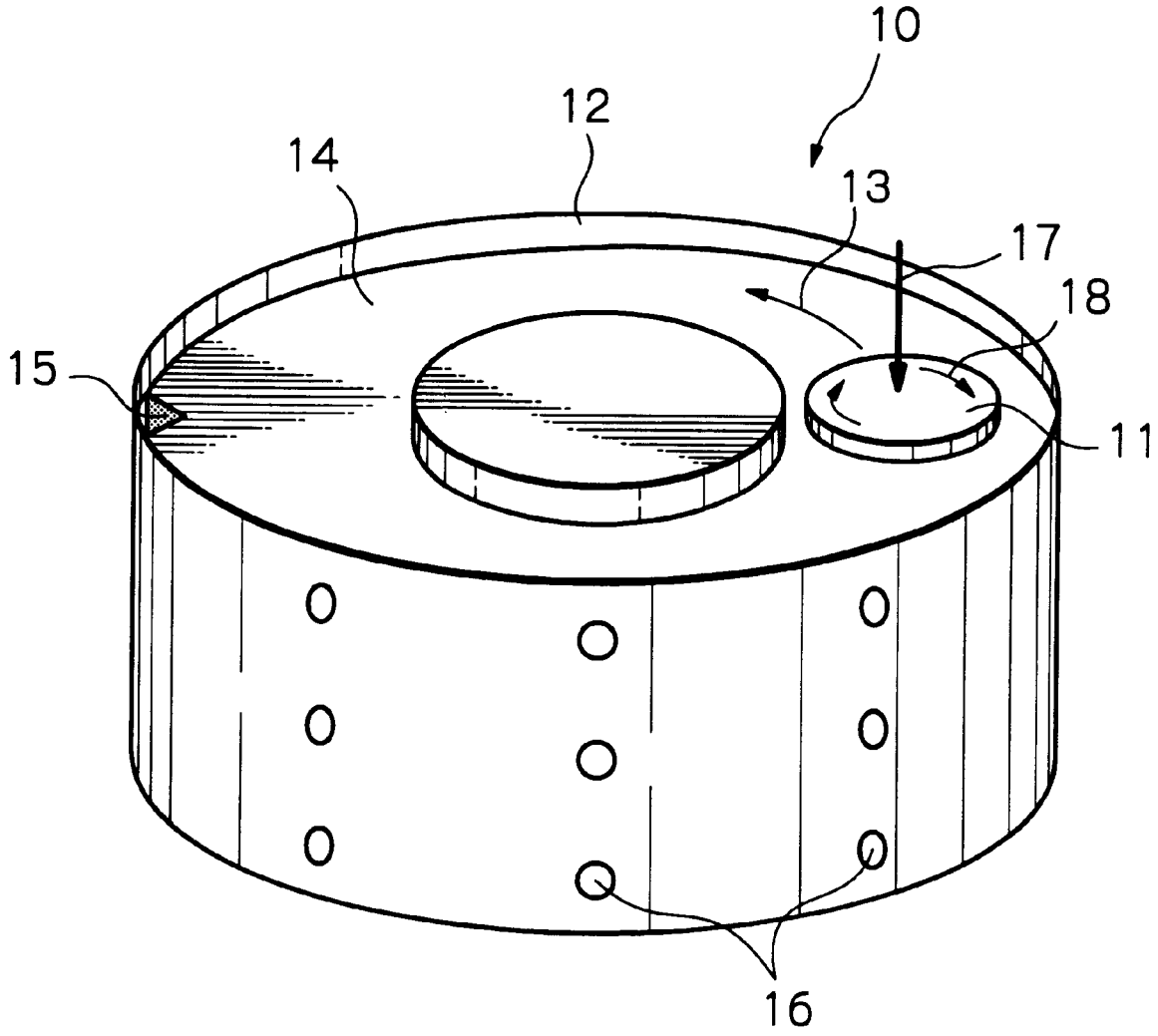
FIG. 1 shows an oblique view schematically illustrating a preferred embodiment of a grinding method according to the present invention.

In FIG. 1, reference numeral 10 denotes a grinding machine, and 11 denotes a microelectronic device to be ground. In this embodiment, the microelectronic device 11 consists of a thin-film magnetic head wafer on which many thin-film magnetic head elements are formed in matrix.

The grinding machine 10 has a cylindrical shaped enclosure 12 that is driven to rotate around in a direction shown by an arrow 13. In the enclosure 12, an abrasive member 14 is accommodated. This abrasive member 14 may be produced by crushing ice into massive form (sherbet state for example) with particle diameters of 0.5–10.0 $\mu$m and by compacting the crushed ice. The abrasive member 14 may be produced by compacting a dry ice, or produced by mixing the crushed ice with the dry ice and by compacting the mixture. The abrasive member 14 is compacted so that its cavity ratio in volume percentage (a volume ratio of cavity in the abrasive member with respect to the whole volume of the abrasive member) becomes 1–50%.

In the figure, furthermore, reference numeral 15 denotes a projection for preventing the abrasive member 14 from rotating, and 16 denotes through holes for releasing gas or liquid in the enclosure 12, respectively.

In order to grind the thin-film magnetic head wafer 11, its patterned surface is pressed against the surface of the abrasive member 14 with a pressure 17 of about 10–500 g/cm$^2$ and simultaneously the wafer 11 itself is rotated about its axis as indicated by an arrow 18 in the figure. The abrasive member 14 is of course rotated with the enclosure 12 as indicated by the arrow 13. Thus, rubbing against grinds the patterned surface of the wafer 11. By this grinding, unnecessary protrusions such as burrs that may be produced on the surface of the wafer 11 during patterning can be effectively removed without inviting scratches or flaws on the ground surface.

Particularly, if dry ice is used as for the abrasive member 14, the ground surface of the wafer 11 can be kept dry resulting that better controls of products can be expected. In addition, since the ground surface of the wafer 11 is covered by a thin gaseous phase of vaporized gas from the dry ice, the patterned surface of the wafer 11 can be protected from occurrence of scratches or flaws. Thus, it is possible to enhance yields of the wafer 11.

In the aforementioned embodiment, the microelectronic device to be ground is the thin-film magnetic head wafer. However, it is apparent that the present invention can be applied to any microelectronic device other than the magnetic head wafer. Also, a solid-phase liquid and a solid-phase gas according to the present invention are not limited to ice and dry ice respectively as in the aforementioned embodiment.

Many widely different embodiments of the present invention may be constructed without departing from the spirit and scope of the present invention. It should be understood that the present invention is not limited to the specific embodiments described in the specification, except as defined in the appended claims.

What is claimed is:

1. A method of grinding a microelectronic device comprising the steps of:

preparing an abrasive member by a method selected from the group of methods consisting of: crushing a solid-phase liquid and compacting the crushed solid-phase liquid into a form for the abrasive member; compacting a solid-phase gas into a form for the abrasive member; and crushing a solid-phase liquid and mixing the crushed solid-phase liquid with a solid-phase gas and compacting the mixed solid-phase liquid and solid-phase gas into a form for the abrasive member; and pressing a surface of the microelectronic device to be ground against said abrasive member.

2. The method as claimed in claim 1, wherein said method further comprises a step of moving said microelectronic device to be ground relative to said abrasive member.

3. The method as claimed in claim 2, wherein said moving step includes rotating said abrasive member.

4. The method as claimed in claim 2, wherein said moving step includes rotating said microelectronic device itself about its axis.

5. The method as claimed in claim 1, wherein said solid-phase liquid consists of ice.

6. The method as claimed in claim 1, wherein said solid-phase gas consists of dry ice.

7. The method as claimed in claim 1, wherein a solid-phase liquid is crushed to a particle diameter of 0.5 to 10 $\mu$m.

8. The method as claimed in claim 1, wherein the crushed solid-phase liquid is compacted so that a volume ratio of cavity in the abrasive member with respect to the whole volume of the abrasive member is 1–50%.

9. The method as claimed in claim 1, wherein the microelectronic device is pressed against the abrasive member at a pressure of 10–500 g/cm$^2$.

* * * * *